US012338600B1

(12) United States Patent
Delcoure

(10) Patent No.: US 12,338,600 B1
(45) Date of Patent: Jun. 24, 2025

(54) DEVICE AND METHOD FOR DRIVING AND REMOVING T-POSTS

(71) Applicant: Robert R. Delcoure, Glenpool, OK (US)

(72) Inventor: Robert R. Delcoure, Glenpool, OK (US)

( * ) Notice: Subject to any disclaimer, the term of this patent is extended or adjusted under 35 U.S.C. 154(b) by 35 days.

(21) Appl. No.: 18/494,267

(22) Filed: Oct. 25, 2023

Related U.S. Application Data

(60) Provisional application No. 63/420,764, filed on Oct. 31, 2022.

(51) Int. Cl.
*E02D 7/04* (2006.01)
*E04H 17/26* (2006.01)

(52) U.S. Cl.
CPC ..... *E02D 7/04* (2013.01); *E04H 17/265* (2013.01)

(58) Field of Classification Search
CPC ..... E04H 17/26; E04H 17/263; E04H 17/265; E02D 7/04
See application file for complete search history.

(56) References Cited

U.S. PATENT DOCUMENTS 1,646,039 A * 10/1927 Murton ..... E04H 17/263 52/749.1
1,848,426 A * 3/1932 Kvall ..... B66F 15/00 254/131
2,098,146 A * 11/1937 Hunt ..... E04H 17/263 173/126
2,998,087 A * 8/1961 Iddings ..... E02D 7/04 173/133
3,115,199 A * 12/1963 Linabery ..... E04H 17/263 173/126
3,712,389 A * 1/1973 Smoak ..... B25D 1/00 173/90
3,991,976 A * 11/1976 Skinner ..... E01F 9/623 254/131
5,029,651 A * 7/1991 Ubbink ..... E21B 7/26 173/90
5,042,591 A * 8/1991 Hull ..... B25D 1/16 173/132
5,794,918 A * 8/1998 Price ..... E04H 17/265 254/113
6,364,031 B1 * 4/2002 Amicangelo ..... E02D 7/04 173/90
7,111,690 B2 * 9/2006 Kleinert ..... E04H 17/263 173/132
7,832,497 B2 * 11/2010 Wilson ..... E04H 17/263 173/90
7,837,177 B2 * 11/2010 McNeill ..... E04H 17/263 254/131
7,963,051 B2 * 6/2011 Ford ..... E04H 17/265 37/195

(Continued)

OTHER PUBLICATIONS

Web Page—https://www.homedepot.com/p/Everbilt-3-in-x-9-in-x-24-in-Metal-Fence-Post-Driver-901147EB/205960880.

*Primary Examiner* — Anna K Kinsaul
*Assistant Examiner* — David G Shutty
(74) *Attorney, Agent, or Firm* — Dennis D. Brown; Brown Patent Law, P.L.L.C.

(57) ABSTRACT

An all-in-one driving and extracting tool for both driving and extracting T-posts for fences, and methods of extracting and driving T-posts using the all-in-one driving and extracting tool.

9 Claims, 2 Drawing Sheets

(56) References Cited

U.S. PATENT DOCUMENTS

| | | | | |
|---|---|---|---|---|
| 8,230,944 | B2 * | 7/2012 | Thiem | E04H 17/268 173/90 |
| 8,701,791 | B2 * | 4/2014 | Page | E04H 17/265 173/90 |
| 8,955,612 | B2 * | 2/2015 | O'Toole | E02D 7/00 173/132 |
| D786,031 | S * | 5/2017 | Whitten | D8/14 |
| D829,517 | S * | 10/2018 | Coleman | D8/14 |
| 10,364,590 | B1 * | 7/2019 | Johnston | B25D 1/16 |
| 2007/0181320 | A1 * | 8/2007 | Mason | B25D 1/16 173/90 |
| 2012/0193111 | A1 * | 8/2012 | Lechtenberg | B25D 17/02 173/90 |
| 2018/0202188 | A1 * | 7/2018 | Dishman | E04H 17/263 |
| 2018/0258603 | A1 * | 9/2018 | Zhang | E02D 7/04 |
| 2019/0119948 | A1 * | 4/2019 | Dishman | E04H 17/263 |
| 2022/0048175 | A1 * | 2/2022 | Varnum | B25G 1/10 |
| 2022/0064988 | A1 * | 3/2022 | Hull | E04H 17/265 |

* cited by examiner

DEVICE AND METHOD FOR DRIVING AND REMOVING T-POSTS

RELATED CASE

This application claims the benefit of U.S. Provisional Patent Application No. 63/420,764 filed Oct. 31, 2022 and incorporates said provisional application herein by reference in its entirety as if fully set forth at this point.

FIELD OF THE INVENTION

The present invention relates to tools and methods for driving and removing T-posts.

BACKGROUND OF THE INVENTION

A T-post is an elongate (slender) metal fence post having a cross-sectional shape which is at least roughly in the form of a T. A T-post will typically also include a series of projecting, evenly spaced stubs which are provided along the length of the post for the purpose of (a) attaching or retaining a laterally extending fence wire at a desired height, (b) attaching or retaining two or more laterally extending fence wires at different heights, or (c) attaching or retaining a wire fence mesh. An anchor plate will also typically be welded to the T-post near the lower end thereof to assist in securely anchoring the T-post in the ground. T-posts are commonly made of steel.

Rather than purchasing a high-cost pneumatic pounder of the type used by professional fence installing companies, most individuals will use a low-cost manual tool for driving T-posts into the ground. A manual T-post driving tool will typically comprise a tube, such as a segment of pipe, which is from about 20 to about 36 inches in length, having a pair of handles welded on opposite sides thereof. The tube will typically be about 3 inches in diameter and will have (i) an open lower end for receiving the upper end of the T-post and (ii) a closed upper end which contacts and hammers the upper end of the post.

Manually extracting a T-post from the ground has been a difficult and strenuous process which requires the use of a separate extraction tool, different from the driving tool. Most homemade or off-the-shelf extraction tools use some sort of lever and fulcrum arrangement where the lever has a chain, jaw, or clamp on the distal end thereof which engages the T-post for lifting. The prior art extraction tools are large and heavy, and include moving parts that can wear out and break. Having to carry both a driving tool and an extraction tool to different worksites in order to be able to both remove and install T-posts can be difficult, tiring, and frustrating. Moreover, some common extraction tools, such as those which use a pole leveraged on a cinder block, can also be quite hazardous.

Consequently, a need exists for an improved tool and method for extracting T-posts from the ground. The improved tool and method will preferably be both (a) safe, convenient, and efficient to use and (b) inexpensive to produce and purchase. The inventive tool and method will also preferably eliminate the need to purchase, carry, and use separate tools for driving and extracting T-posts.

SUMMARY OF THE INVENTION

The present invention satisfies the needs and alleviates the problems mentioned above. In one aspect, there is provided a multifunctional tool for driving and extracting T-posts. The tool features a ratcheting mechanism that catches the notches on the T-post for pulling it out of the ground or extracting it. The tool allows the user to safely surround the edges of the post so the inner lip of the device can be adjusted against the nubs for firmly pulling or pushing the post. The tool eliminates the need for purchasing and using two independent tools with moving parts to complete both installation and extraction tasks.

In another aspect, there is provided a tool for driving and extracting a T-post, wherein the T-post is of a type having a series of projecting stubs and the series of projecting stubs extends along at least a portion of a length of the T-post. The tool preferably comprises: (a) a tube having a longitudinal axis, a first longitudinal end which is open, a second longitudinal end which is closed, and a tube wall which extends from the first longitudinal end to the second longitudinal end and (b) an open extraction slot formed in the tube wall. The open extraction slot has a lateral opening at the first longitudinal end of the tube and the open extraction slot extends from the first longitudinal end of the tube toward the second longitudinal end of the tube for a longitudinal length which is less than one-half of the total longitudinal length of the tube.

The open extraction slot of the tool and the lateral opening thereof are of sufficient lateral width that when the tool is positioned with the second longitudinal end of the tube oriented downward and the first longitudinal end of the tube is tilted toward the T-post, the T-post will be received in the open extraction slot such that a portion of an edge of the tube wall at the first longitudinal end of the tube, opposite the lateral opening of the open extraction slot, will contact the T-post between an adjacent pair of the projecting stubs.

In another aspect, there is provided a method of extracting a T-post having a series of projecting stubs, wherein the series of projecting stubs extends along at least a portion of a length of the T-post. The method preferably comprises the steps of: (a) placing a lower end of an extraction tool on a ground surface, the extraction tool comprising a tube having an open extraction slot formed in a wall of the tube, the open extraction slot having a lateral opening at an upper longitudinal end of the tube and the open extraction slot extending from the upper longitudinal end of the tube toward a lower longitudinal end of the tube for a longitudinal length which is less than one-half of the total longitudinal length of the tube; (b) before, during, or after step (a), receiving the T-post in the open extraction slot such that a portion of an edge of the wall of the tube at the upper longitudinal end of the tube, opposite the lateral opening of the open extraction slot, contacts the T-post between a first adjacent pair of the projecting stubs; (c) pulling or pushing an upper portion of the T-post in a direction toward the extraction tool such that the portion of the edge of the wall of the tube catches an upper one of the first adjacent pair of the projecting stubs so that the T-post is pulled upwardly; and (d) pulling or pushing the upper portion of the T-post in a direction away from the extraction tool so that the portion of the edge of the wall of the tube drops downwardly to a position between a second adjacent pair of the projecting stubs which is below the first adjacent pair of the projecting stubs.

In another aspect, there is provided an all-in-one tool for extracting T-posts as well as driving them into the ground. The device is comprised of a ratcheting mechanism that catches on the notches of a T-post, wherein the device is pressed into the side of the post to slip up and down the notches between the stubs of the post when it is moved backward or forward. The device eliminates the need to use multiple heavy-duty tools when dealing with posts in the ground. There is an alignment extraction notch on the open cylinder end of the tool. It allows the user to safely surround the edges of the T-post, so the inner lip of T-Post Driver can be adjusted against the post nubs. Firmly pulling and pushing the T-Post Driver will remove said T-Post. Exact size, measurements, construction, and design specifications are adaptable and can vary.

Further objects, features, and advantages of the present invention will be apparent to those in the art upon examining the accompanying drawings and upon reading the following Detailed Description of the Preferred Embodiments.

DETAILED DESCRIPTION OF THE PREFERRED EMBODIMENTS

Figure 3:
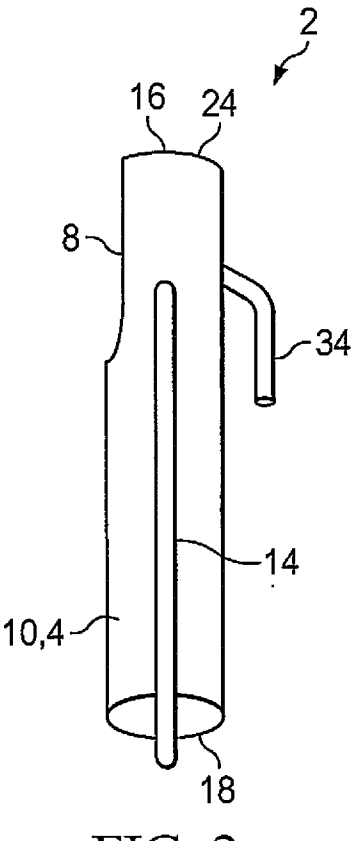
FIG. 3 is a side elevational view of the of the inventive tool 2
Figure 2:
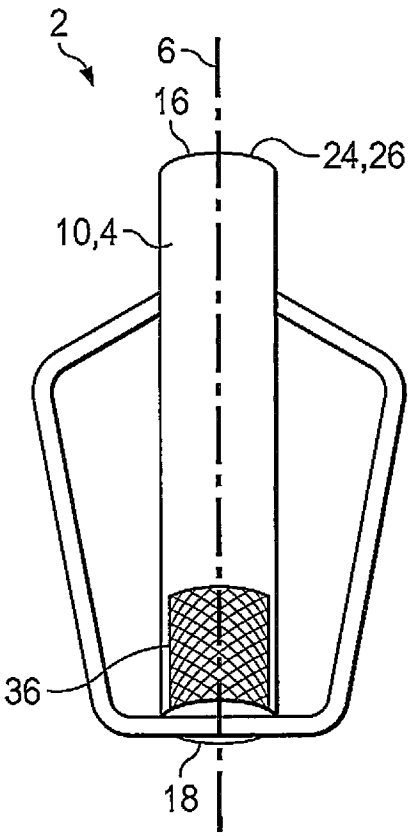
FIG. 2 is a rear elevational view of the inventive tool 2.
Figure 1:
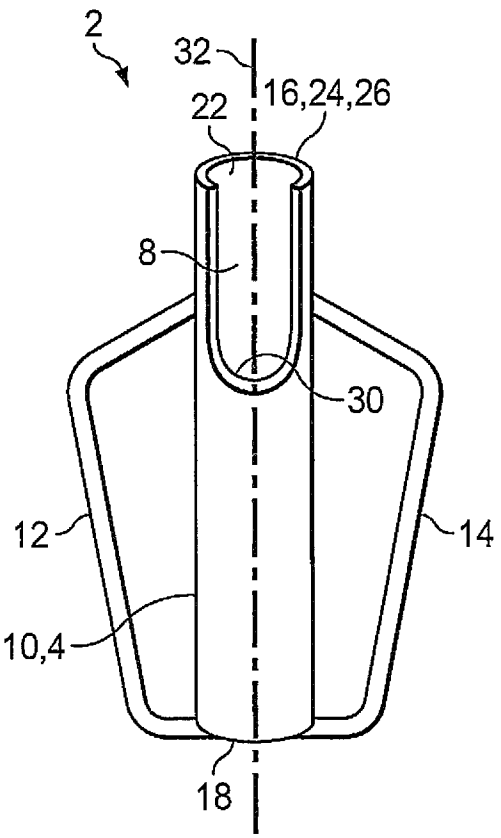
FIG. 1 is a front elevational view of an embodiment 2 of the driving and extraction tool provided by the present invention.
Figure 4:
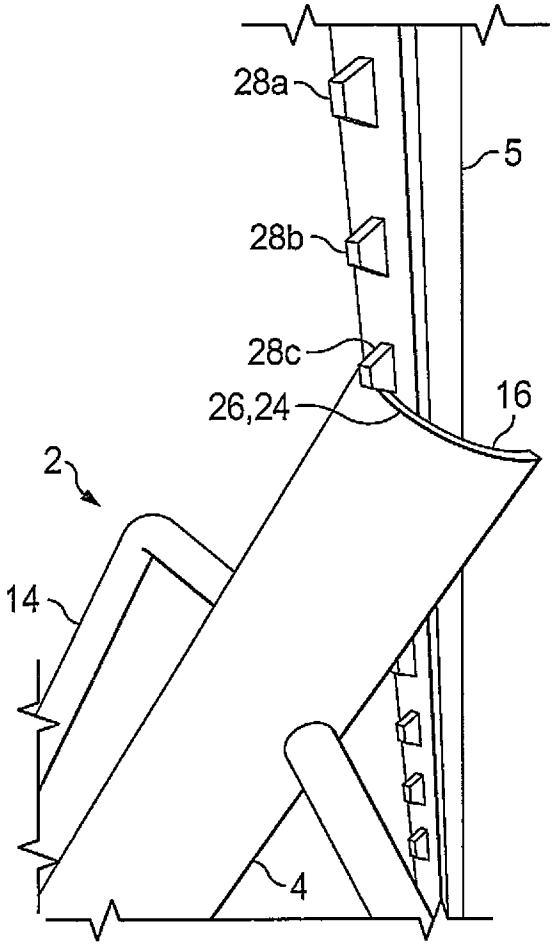
FIG. 4 is a first view of the inventive tool 2 engaged with a T-post 5.
Figure 5:
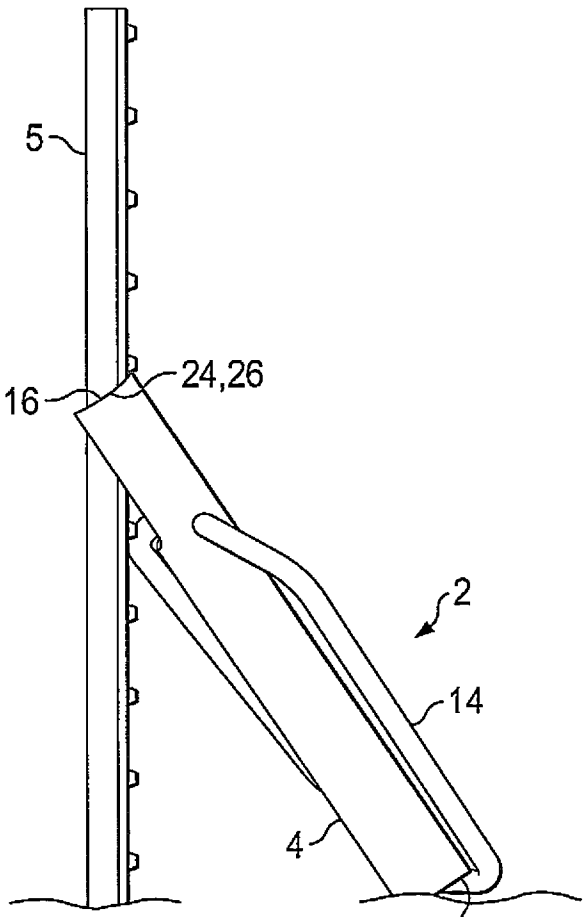
FIG. 5 is a second view of the inventive tool 2 engaged with the T-post 5.

An embodiment 2 of the inventive tool for manually driving and extracting a T-post 5 is shown in FIGS. 1-5. The inventive tool 2 preferably comprises: (a) a tube 4 having a longitudinal axis 6; (b) an open extraction slot 8 which is formed in the wall 10 of the tube 4; and (c) a pair of handles 12 and 14 which are secured, e.g., by welding or in any other suitable manner, on opposite sides of the tube 4.

The tube 4 comprises a first longitudinal end 16 which is open and a second longitudinal end 18 which is closed. The tube wall 10 extends from the first longitudinal end 16 to the second longitudinal end 18.

When the inventive tool 2 is used for driving the T-post 5 into the ground, the first longitudinal end 16 of the tube 4 will become a lower end of the tool 2, in which the upper end of the T-post 5 will be received, and the second longitudinal end 18 of the tool 2 will be used to contact and drive/hammer the T-post 5 into the ground. However, when the inventive tool 2 is used to extract the T-post 5 from the ground, the first longitudinal end 16 of the tube 4 will become the upper end of the tool 2.

The open extraction slot 8 formed in the tube wall 10 has a lateral opening 22 at the first longitudinal end 16 of the tube 4. The open extraction slot 8 extends from the first open longitudinal end 16 of the tube 4 toward the second longitudinal end 18. The longitudinal length of the open extraction slot 8 is preferably not more than half, more preferably less than half, of the total longitudinal length of the tube 4.

The longitudinal length of the tube 4 will preferably be in the range of from about 20 inches to about 36 inches and will more preferably be from about 24 to about 34 inches. As used herein and in the claims, the term "about", when used in reference to a dimensional size or arc, encompasses a range of ±10%.

The cross-sectional shape of the tube 4 can be circular, square, rectangular, or any other shape desired. The tube 4 will preferably be cylindrical and will more preferably be formed of a segment of pipe. For a cylindrical tube 4 having a circular cross-sectional shape, the internal diameter of the tube 4 will preferably be in the range of from about 2 inches to about 5 inches and will more preferably be in the range of from about 2.5 inches to about 4 inches. The internal diameter of the tube 4 will more preferably be about 3 inches.

The tube 4 will preferably be formed of metal, more preferably steel, and will most preferably be formed of a segment of 3 inch pipe.

The open extraction slot 8 and the lateral opening 22 thereof are of sufficient lateral width that when the inventive tool 2 is positioned with the closed longitudinal end 18 of the tube 4 oriented downward (i.e., with the closed end of the tool 2 supported on a ground surface) and the first longitudinal end 16 of the tube 4 is tilted toward the T-post 5, the T-post 5 will be received in the open extraction slot 8 such that a portion 24 of the upper edge 26 of the tube wall 10 at the first longitudinal end 16 of the tube 4 will contact the T-post 5 between an adjacent pair 28*a* and 28*b* of the stubs which project from the T-post 5. The portion 24 of the upper edge 26 (i.e., the back edge) of the tube wall 10 which is received between the projecting stubs 28*a* and 28*b* is positioned opposite the lateral opening 22 of the open extraction slot 20.

For a cylindrical tube 4, the edge 26 of the tube wall 10 at the first open longitudinal end 16 will preferably have a C-shape.

The longitudinal length of the open extraction slot 8 will preferably be in the range of from about 3 to about 12 inches. The longitudinal length of the open extraction slot 8 will more preferably be in the range of from about 5 to about 11 inches and will more preferably be in the range of from about 8 to about 10 inches. The other longitudinal end 30 of the open extraction slot 8, which is opposite the lateral opening 22 of the slot 8, will preferably curve toward the second longitudinal end 18 of the tube 4. The open extraction slot 8 and the lateral opening 22 thereof will preferably have a width which is in the range of from about 1.5 inches to about 2.5 inches and is more preferably about 2 inches.

The handles 12 and 14 of the inventive tool 2 are welded or otherwise attached to the tube 4 so that the handles 12 and 14 do not obstruct the open extraction slot 8. The handles 12 and 14 are preferably positioned (i) about 180° from each other and (ii) about 90° from a longitudinally extending center line 32 of the open extraction slot 8 which is parallel to the longitudinal axis 6 of the tube 4.

The inventive tool 2 can also comprise an extraction adjustment handle 34 which is welded or otherwise attached to the tube 4 at a location which is preferably (i) adjacent to the first longitudinal end 16 of the tube 4 and (ii) opposite the open extraction slot 8. The handle 34 can be used to position or reposition the portion 24 of the first longitudinal end 16 of the tube 4 between any desired pair of the projecting stubs 28*a* and 28*b* of the T-post 5 at a desired height.

In addition, the inventive tool 2 can further comprise a slip-resistant surface 36 on the exterior of the tube wall 10 which is preferably located (i) adjacent to the second longitudinal end 18 of the tube 4 and (ii) on the lateral side of the tube 4 which is opposite the lateral side of the open extraction slot 8. When extracting a T-post 5 from the ground, the user can place a foot on the slip resistant surface 36 for greater leverage when pushing or pulling the T-post 5 toward or away from the inventive tool 2. By way of example, but not by way of limitation, the slip resistant surface 36 can compromise boot grooves formed in the exterior of the tube 4 or a strip of sticky sandpaper or other slip resistant material.

In the method of the present invention for extracting the lower end portion of a T-post 5 from the ground, the closed end of the inventive driving and extraction tool 2 is placed on the ground surface adjacent to the T-post 5. Either before, after, or while placing the closed end of the tool 2 on the ground, the T-post 5 is received in the open extraction slot 8 of the tool 2 (e.g., by tilting the first upper end 16 of the tube 4 toward the T-post 5) such that the portion 24 of the first upper end 16 of the tube wall 10 contacts the T-post 5 between an adjacent pair 28*a* and 28*b* of the projecting stubs of the T-post 5. The user then pulls or pushes the upper portion of the T-post 5 in a direction toward the tool 2 such that the portion 24 of the first upper end 16 of the tool 2 catches the upper stub 28*a* of the pair of projecting stubs 28*a* and 28*b*, which results in the T-post 5 being pulled upwardly.

Next, the user pulls or pushes the upper portion of the T-post 5 away from the tool 2 so that the portion 24 of the first upper end 16 of the tool 2 falls (ratchets) downwardly to a position between a lower adjacent pair 28*b* and 28*c* of the projecting stubs.

The steps of pulling or pushing the upper portion of the T-post 5 toward and then away from the inventive tool 2 are then repeated until the T-post 5 is free from the ground or is at least sufficiently free to allow the T-post 5 to be lifted out of the ground by hand.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

Thus, the present invention is well adapted to carry out the objects and attain the ends and advantages mentioned above as well as those inherent therein. While presently preferred embodiments have been described for purposes of this disclosure, numerous changes and modifications will be apparent to those in the art. Such changes and modifications are encompassed within the invention as described herein and in the claims.

What is claimed is:

1. A tool for driving and extracting a T-post, the T-post being of a type having a series of projecting stubs, the series of projecting stubs extending along at least a portion of a length of the T-post, and the tool comprising:

a tube having (i) a longitudinal axis, (ii) a first longitudinal end which is open, (iii) a second longitudinal end which is closed, and (iv) a tube wall which extends from the first longitudinal end to the second longitudinal end;

an open extraction slot formed in the tube wall, the open extraction slot having a lateral opening at the first longitudinal end of the tube and the open extraction slot extending from the first longitudinal end of the tube toward the second longitudinal end of the tube for a longitudinal length which is less than one-half of a total longitudinal length of the tube;

the open extraction slot and the lateral opening thereof being of sufficient lateral width that when the tool is positioned with the second longitudinal end of the tube oriented downward and the first longitudinal end of the tube is tilted toward the T-post, the T-post will be received in the open extraction slot such that a portion of an edge of the tube wall at the first longitudinal end of the tube, opposite the lateral opening of the open extraction slot, will contact the T-post between an adjacent pair of the projecting stubs; and a slip resistant surface on an exterior of the tube wall, the slip resistant surface being positioned on a lateral side and on a longitudinal end portion of the tube wall which are opposite a lateral side location and a longitudinal end portion location of the open extraction slot.

2. The tool of claim 1 further comprising the tube being cylindrical and the edge of the tube wall at the first longitudinal end of the tube having a C shape.

3. The tool of claim 1 further comprising the tube being formed of a segment of three inch pipe.

4. The tool of claim 1 further comprising (i) the first longitudinal end of the tube being a lower end of the tool when the tool is used for driving the T-post and (ii) the first longitudinal end of the tube being an upper end of the tool when the tool is used for extracting the T-post.

5. The tool of claim 1 further comprising a first driving handle on positioned on a first side of the tube and a second driving handle positioned on a second side of the tube opposite the first handle.

6. The tool of claim 5 further comprising an extraction adjustment handle, different from the first driving handle and the second driving handle, positioned on the tube at a location opposite the open extraction slot.

7. The tool of claim 1 further comprising:

the total longitudinal length of the tube being in a range from about 20 inches to about 36 inches and the longitudinal length of the open extraction slot being in a range from about 8 inches to about 10 inches.

8. The tool of claim 1 further comprising the open extraction slot and the lateral opening thereof having a width of about 2 inches.

9. The tool of claim 1 further comprising the open extraction slot having a longitudinal end, opposite the lateral opening of the open extraction slot, which is curved.

* * * * *